United States Patent [19]

Bernarducci et al.

[11] Patent Number: 4,755,327

[45] Date of Patent: Jul. 5, 1988

[54] ISOTROPIC LAUNDRY DETERGENTS CONTAINING POLYMERIC QUATERNARY AMMONIUM SALTS

[75] Inventors: Ernest Bernarducci, Rutherford, N.J.; Kenneth A. Harrison, Monsey, N.Y.

[73] Assignee: Sterling Drug Inc., New York, N.Y.

[21] Appl. No.: 935,658

[22] Filed: Nov. 26, 1986

[51] Int. Cl.[4] ..... C11D 1/62

[52] U.S. Cl. ..... 252/547; 252/106; 252/173; 252/174.21; 252/528; 252/DIG. 14

[58] Field of Search ..... 252/547, 528, 106, DIG. 14, 252/173, 174.21; 514/642

[56] References Cited

U.S. PATENT DOCUMENTS

| | | | |
|---|---|---|---|
| 3,771,989 | 11/1973 | Pera et al. | 71/67 |
| 3,931,319 | 1/1976 | Green et al. | 260/567.6 P |
| 4,001,432 | 1/1977 | Green et al. | 424/329 |
| 4,012,446 | 3/1977 | Green et al. | 260/567.6 P |
| 4,027,020 | 5/1977 | Green et al. | 424/248.56 |
| 4,091,113 | 5/1978 | Green et al. | 424/329 |
| 4,157,387 | 6/1979 | Benedict | 424/54 |
| 4,333,862 | 6/1982 | Smith et al. | 252/547 |
| 4,525,346 | 6/1985 | Stark | 424/78 |
| 4,576,729 | 3/1986 | Parzek et al. | 252/DIG. 14 |

OTHER PUBLICATIONS

Busan 77, A Broad-Spectrum Microbicide Concentrations, Buckman Lab. Inc., Memphis, Tennessee 38108, May 28, 1980.

WSCP, Poly[Oxyethylene(Dimethyliminio)Ethylene(-Dimethyliminio)Ethylene Dichloride], Buckman Lab. Inc., Memphis, Tennessee 38108, Jul. 25, 1984.

*Primary Examiner*—Paul Lieberman
*Assistant Examiner*—Hoa Van Le
*Attorney, Agent, or Firm*—William G. Webb; Paul E. Dupont

[57] ABSTRACT

Stable, isotropic liquid laundry detergent and sanitizer compositions comprising a polymeric linear quaternary ammonium salt, one or more nonionic surfactants and water.

13 Claims, No Drawings

ISOTROPIC LAUNDRY DETERGENTS CONTAINING POLYMERIC QUATERNARY AMMONIUM SALTS

BACKGROUND OF THE INVENTION

This invention relates to isotropic liquid laundry detergents containing polymeric quaternary ammonium salts in combination with one or more nonionic surfactants.

INFORMATION DISCLOSURE STATEMENT

Pera et al. U.S. Pat. No. 3,771,989 discloses polymeric polyelectrolytes, useful as algicides, having the formula:

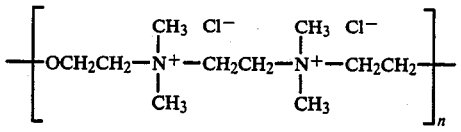

where n is an integer from 4 to 40, with molecular weights ranging from 1,000 to 10,000, which are chemically designated poly[oxyethylene(dimethyliminio)ethylene(dimethyliminio)ethylene dichloride]. As far as is presently known, compounds of this class are not known to have useful bactericidal properties nor are they known to be useful for incorporation in laundry detergents.

Green et al. U.S. Pat. Nos. 3,931,319; 4,001,432 and 4,012,446 disclose so-called "capped" polymers useful as "microbiocidal" agents, which have linear polymeric quaternary chains terminated by quaternary ammonium moieties, having the formula:

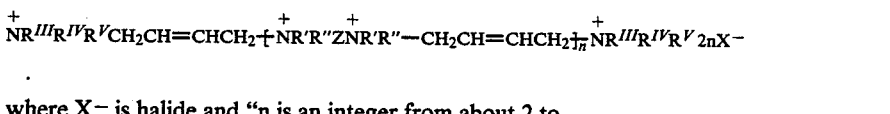

where $X^-$ is halide and "n is an integer from about 2 to about 30; where R' and R'' may be either (1) a primary or secondary alkyl radical having from 1 to 20 carbon atoms, (2) hydroxy or dihydroxy derivatives of R' and R'', (3) benzyl, or (4) benzyl containing at least one alkyl group . . . ; where Z consists of from one to three aliphatic divalent radicals, each of which has 2 to 10 carbon atoms, each aliphatic radical containing 0 to 2 double bonds and 0 to 2 hydroxy substituents" and where "$R^{III}$, $R^{IV}$ and $R^{V}$ may be either (1) primary or secondary alkyl containing from 1 to 20 carbon atoms, or (2) hydroxyethyl . . . "

Green et al. U.S. Pat. No. 4,027,020 discloses so-called "randomly terminated" capped linear quaternary ammonium polymers generally similar to those described in U.S. Pat. Nos. 3,931,319; 4,001,432 and 4,012,446 above prepared by reaction of a 1,4-dihalo-2-butene, $XCH_2CH{=}CHCH_2X$, where X is halogen, with a mixture of a difunctional tertiary amine:

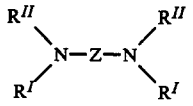

and a monofunctional tertiary amine:

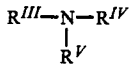

The compounds are said to be effective against bacteria and algae and to a lesser extent against fungi. They are also stated to be non-foaming, a property which is said to be important in anti-microbial agents used in products and processes where the generation of foam is undesirable.

Green et al. U.S. Pat. No. 4,091,113 discloses "randomly terminated" capped linear quaternary ammonium polymers prepared in the same manner as described in U.S. Pat. No. 4,027,020 supra. The quaternaries are said to be "uniquely excellent hair conditioning agents" which are "compatible in binary or tertiary systems with most of the lathering and cleansing surfactants used in hair conditioning consumer products". The patentee states that 40% aqueous solutions are non-irritating to the skin and that 4% aqueous solutions are non-irritating to the eyes. More specifically, the quaternaries are described as being compatible with surfactants and emulsifiers of the cationic, nonionic, amine oxide, alkylolamide, amphoteric, aminoacetic or β-aminopropionic acid and betaine or betaine salt classes. The compositions are exemplified in Examples 28, 29 and 30 by formulations containing the polymeric quaternary which is produced by reaction of 1,4-bis-dimethylamino-2-butene, triethanolamine and 1,4-dichloro-2-butene in water in combination with surfactants of the cationic (AMMONYX ®4, i.e. stearalkonium chloride—Example 30), nonionic (TERGITOL ®15-S-12, i.e. pareth-15-12—Example 29), alkylolamide (ONYXOL ®42, i.e. stearyl diethanolamide—Example 30 and SUPER AMIDE ® GR, i.e. cocoyldiethanolamide—Example 28), amphoteric (MIRANOL ®C-2M-SF, i.e. cocoamphocarboxypropionate and SANDOPAN ® TFL, i.e. oleoamphopropylsulfonate—both Example 28) and anionic (MAPROFIX ®60S, i.e. sodium laureth sulfate—Example 28) classes. As far as is presently known the compounds of the structural type disclosed in U.S. Pat. Nos. 3,931,319; 4,001,432; 4,012,446; 4,027,020 and 4,091,113 above are not known to have been previously incorporated in laundry detergents.

Smith et al. U.S. Pat. No. 4,333,862 discloses, as one possible cationic surfactant in liquid detergent compositions containing an anionic, a cationic and a nonionic surfactant, polyammonium salts of the formula:

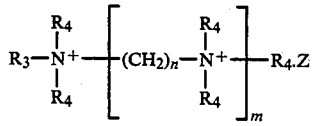

where $R_3$ is $C_8$–$C_{20}$ alkyl, alkenyl or aralkyl; each $R_4$ is $C_1$–$C_4$ alkyl or hydroxyalkyl; n is from 1 to 6; and m is from 1 to 3.

SUMMARY OF THE INVENTION

As noted above, polymeric linear quaternary ammonium salts of the structural types represented by those disclosed in U.S. Pat. Nos. 3,771,989; 3,931,319; 4,001,432; 4,012,446; 4,027,020 and 4,091,113 are not known to have been incorporated in laundry detergents. We have discovered that polymeric quaternary ammonium salts of those classes, when formulated in an aqueous medium with one or more nonionic surfactants, provide stable, isotropic liquid laundry detergents and sanitizer compositions having good detergency and bactericidal properties, which, in addition, are moderately irritating to the eyes and practically non-irritating to the skin.

Accordingly, the invention resides in stable, isotropic liquid laundry detergent and sanitizer compositions comprising: (A) a polymeric linear quaternary ammonium salt selected from the group consisting of a poly-[oxyethylene(di-lower-alkyliminio)ethylene(di-lower-alkyliminio)ethylene dihalide] and a polymeric quaternary ammonium halide corresponding to formula IB hereinbelow; (B) one or more nonionic surfactants selected from the group consisting of the polyethylene glycol long chain alkyl ether, polyethylene glycol alkylphenyl ether, N-alkyl-N,N-di-lower-alkylamine-N-oxide and alkyl polyglycoside classes; and (C) water.

DETAILED DESCRIPTION OF THE PREFERRED EMBODIMENTS

More specifically the isotropic liquid laundry detergent and sanitizer compositions of the invention comprise: (A) a polymeric linear quaternary ammonium salt selected from the group consisting of a poly[oxyethylene(di-lower-alkyliminio)ethylene(di-lower-alkyliminio)ethylene dihalide] having the formula:

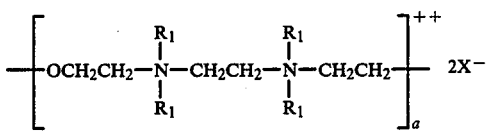

IA where $R_1$ is lower-alkyl having from one to four carbon atoms, a is an integer from 4 to 40, with an average value of 19, and $X^-$ is halide, and a polymeric quaternary ammonium halide having the formula:

$$(R_2)_3\overset{+}{N}-CH_2CH{=}CHCH_2- \qquad \text{IB}$$

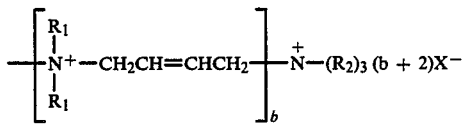

where $R_2$ is hydroxy-lower-alkyl having from two to four carbon atoms, b is an integer from 27 to 57 and $R_1$ and $X^-$ have the meanings given above; (B) one or more nonionic surfactants selected from the group consisting of a polyethylene glycol long chain alkyl ether having the formula:

$$R_4-(OCH_2CH_2)_cOH \qquad \text{IIA}$$

where $R_4$ is $C_{11}$–$C_{15}$ alkyl and c is an integer from 5 to 15, a polyethylene glycol alkylphenol ether having the formula:

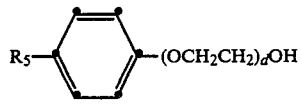

IIB where $R_5$ is $C_8$–$C_9$ alkyl and d is an integer from 7 to 13; an N-alkyl-N,N-di-lower-alkylamide-N-oxide having the formula:

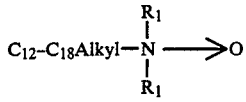

IIC where $R_1$ has the meaning given above and an alkyl polyglycoside; and (C) water.

The polymeric quaternary ammonium salts of formulas IA and IB used to prepare the compositions of the invention are well known classes of compounds. The poly[oxyethylene(di-lower-alkyliminio)ethylene(di-lower-alkyliminio)ethylene dihalide] quaternaries of formula IA include, for example, poly[oxyethylene(-dimethyliminio)ethylene(dimethyliminio)ethylene dichloride] sold under the trade name BUSAN ®77 by Buckman Laboratories, Memphis, Tenn. as a 60% actives solution in water and which is identified as WSCP (water soluble cationic polymer).

The polymeric quaternary ammonium halides of formula IB include, for example, poly(dimethylbutenyl ammonium chloride)-α,ω-bis triethanolammonium chloride (as named by the manufacturer) sold under the trade names ONYXSPERSE ®12S and ONAMER ® M by the Onyx Chemical Company, Jersey City, N.J., now owned by The Stepan Company, Northfield, Ill. ONYXSPERSE ® and ONAMER ® are aqueous solutions of the salt each containing, respectively, 28.5% and 29.5% actives and 12% and 1% sodium chloride respectively.

The nonionic surfactants of formulas IIA, IIB and IIC and the nonionic alkyl polyglycoside surfactants used in the practice of the present invention are well known in commerce. Examples of the polyethylene glycol long chain alkyl ethers of formula IIA are sold under the Union Carbide (Danbury, Conn.) trade name TERGITOL ® or the Shell Chemical Company (Houston, Tex.) trade name NEODOL ® and are identified by the CTFA adopted name, pareth. Suitable members of the group for the practice of the present invention are pareth-15-5, pareth-15-7, pareth-15-9, pareth-15-12, pareth-23-7, pareth-25-5, pareth-25-7, pareth-25-9, pareth-25-12, pareth-45-7, pareth-45-11 and pareth-45-13, where the first given numbers 15, 23, 25 and 45 indicate $R_4$ alkyl chain lengths from 11 to 15, 12 to 13, 12 to 15 and 14 to 15 carbon atoms, respectively, and the second given numbers 5, 7, 9, 11, 12 and 13 indicate the average number (c) of ethyleneoxy groups.

The polyethylene glycol alkyl phenyl ethers of formula IIB are available, for example, under the Rohm and Haas (Philadelphia, Penn.) trade names TRITON ® X and TRITON ® N or the GAF Corporation (Wayne, N.J.) trade names IGEPAL ® CA and IGEPAL ® CO and are identified by the CTFA adopted names of octoxynols and nonoxynols. These include, for example, octoxynol-7, octoxynol-10 and octoxynol-13, where $R_5$ in formula IIB is $C_8$ alkyl and d has an average value of 7, 10 and 13, respectively, and nonoxynol-7, nonoxynol-8, nonoxynol-9 and nonoxynol-13, etc. where $R_5$ in formula IIB is $C_9$ alkyl, and d has an average value of 7, 8, 9 and 13, respectively.

The alkylamine oxides of formula IIC are sold under the trade name AMMONYX ® by the Onyx Chemical Company (Jersey City, N.J.) and include, for example, lauramine oxide, myristylamine oxide, palmitamine oxide and stearamine oxide which are the CTFA adopted names for the compounds of formula IIC where $R_1$ in each instance is methyl and the alkyl group has 12, 14, 16 and 18 carbon atoms respectively.

The nonionic alkyl polyglycoside surfactants are sold by Staley Industrial Products of the A. E. Staley Manufacturing Company (Decatur, Ill.) and include, for example, APG-23-3 which is a surfactant of the alkyl polyglycoside class having an alkyl chain derived from a $C_{12}$–$C_{13}$ straight chain alcohol and an average of 3 glucose units in the polyglycoside moiety.

Although it is preferred in the practice of the present invention to include either one or the other of the polymeric quaternary ammonium salts represented by formulas IA and IB, it is also contemplated that mixtures of salts of those two structural types can, if desired, be used in the liquid laundry detergent formulations of the invention.

The compositions of the invention contain from about 5.5 to about 20 weight percent of the polymeric quaternary ammonium salt of formulas IA or IB and from about 5 to about 50 weight percent of the nonionic surfactant, all amounts being based on total weight of the composition. Preferred ranges are from about 5 to about 10 weight percent of the polymeric quaternary salt and from about 5 to about 17 weight percent of the nonionic surfactant, and particularly preferred amounts are about 5.5 to about 6.5 weight percent of the polymeric quaternary salt and from about 7 to about 12 weight percent of the nonionic surfactant.

The compositions may, in order to provide additional benefits, optionally contain nonessential ingredients such as fragrances, dyes, pH adjusters such as triethylamine, brighteners, solvents such as ethanol, and thickeners. Generally fragrances may be used in amounts up to about 0.7 weight percent, dyes in amounts up to about 0.02 weight percent, pH adjusters in amounts up to about 4 weight percent, brighteners in amounts up to about 0.5 weight percent, ethanol in amounts up to about 7 weight percent, and thickeners in amounts up to about 2.0 weight percent.

The compositions are prepared by addition to water, with stirring and heating as necessary, of the nonionic surfactant(s), followed by alcohol if desired, followed by the polymeric quaternary ammonium salt, followed by the dyes, fragrances, brighteners, pH adjusters or thickeners, stirring being continued at each stage to effect complete solution or homogeneous dispersion.

The compositions of the invention possess very good detergency and bactericidal properties and furthermore have very low eye and skin irritancy. They are therefore particularly valuable in household sanitizing and cleaning operations where such properties are desirable, such as in laundry detergents and hard surface cleaners.

The manner and process of making and using the invention, and the best mode contemplated by the inventors for carrying out the invention, will now be described so as to enable any person skilled in the art to which it pertains to make and to use the same.

EXAMPLES

A number of formulations, composed as indicated in Table 1, each containing a quaternary ammonium salt and at least one nonionic surfactant were prepared using the procedure described above.

Formulations A–K, each containing a polymeric quaternary of formulas IA or IB and one or more nonionic surfactants of formulas IIA, IIB or IIC or an alkyl polyglycoside, are formulated in accordance with the invention as described above and are within the ambit of the invention; whereas formulations L–O, each containing a monomeric quaternary halide, i.e. CYNCAL ®80, and a nonionic surfactant, were prepared for comparative purposes and are outside the scope of the invention.

TABLE 1

| Ingredient | Formulation (Amts. in weight % of actives) | | | | | | | | | | | | | | |
|---|---|---|---|---|---|---|---|---|---|---|---|---|---|---|---|
| | A | B | C | D | E | F | G | H | I | J | K | L | M | N | O |
| ONAMER ® M (29.5) | 6.4 | — | — | — | — | 6 | — | — | — | — | — | — | — | — | — |
| ONYXSPERSE ® 12S (28.5%) | — | 5.5 | — | — | 6 | — | 6 | 6 | 6 | 5.5 | 5.5 | — | — | — | — |
| BUSAN ® 77 (60%) | — | — | 6.4 | 6.4 | — | — | — | — | — | — | — | — | — | — | — |
| CYNCAL ® 80 (80%) | — | — | — | — | — | — | — | — | — | — | — | 6.4 | 6.4 | 6.4 | 5.5 |
| pareth-23-7 | — | — | 12 | — | 5 | — | — | — | — | — | — | 17 | 12 | — | — |
| pareth-45-7 | 12 | — | — | 12 | — | 12 | — | — | — | — | — | — | — | 12 | — |
| TERGITOL-24-L-98 NMW | — | 10 | — | — | — | — | — | 9 | — | — | — | — | — | — | 10 |
| pareth-15-12 | — | — | — | — | — | — | 9 | — | 5 | — | — | — | — | — | — |
| pareth-15-9 | — | — | — | — | — | — | — | — | — | 5 | 8.3 | — | — | — | — |
| nonoxynol-9 | — | — | — | — | — | — | — | — | — | 2.6 | — | — | — | — | — |
| AMMONYX ® LO | — | — | — | — | 2 | — | — | — | — | — | 3 | — | — | — | — |
| APG 23-3 (46%) | — | — | — | — | — | — | — | — | 7 | 2.6 | — | — | — | — | — |
| EtOH | — | — | — | — | 7 | — | — | 5 | — | — | — | — | — | — | — |
| Dye, fragrance, water | q.s. | q.s. | q.s. | q.s. | q.s. | q.s. | q.s. | q.s. | q.s. | q.s. | q.s. | q.s. | q.s. | q.s. | q.s. |

The formulations of the invention and the comparative formulations were tested for cleaning efficacy using the standard EMPA and Krefeld detergency tests; for germicidal activity against *K. pneumoniae* ATCC 4352 and *S. aureus* ATCC 6538 using the EPA-approved Petrocci-Clark test procedure [Proposed Test Method for Antimicrobial Laundry Additives, Petrocci and Clark, J. Ass. Offic. Anal. Chem. 52(4), 836–842 (1969)] which is a simulated in-use test method (see EPA Publication DIS/TSS-13, May 2, 1979); for eye irritation in rabbits using the standard FIFRA method (described at 40 C.F.R. 163.81-4); and for skin irritation using the standard FIFRA dermal irritation test in rabbits (NAS 1138 modification described at 40 C.F.R. 163.81-5).

The EMPA and Krefeld detergency tests used in the present study are described in U.S. Pat. No. 4,576,729 except that the temperature of the wash and rinse water was 105° F. instead of 120°–130° F. In the EMPA test (a test by the Swiss Federal Testing Station in Switzerland), the standard soil is an India ink and olive oil emollient (an oily type soil), and in the Krefeld test (a test by the Wascherei Forschungs Institute of Krefeld, West Germany), the soil is 84% clay, 8% lamp black, 4% black iron oxide and 2% yellow iron oxide oversprayed with a solution of 3.4% lanolin dissolved in carbon tetrachloride and salt solution (the salt to resemble human perspiration). The cleaning efficacy, expressed as % Soil Removal, was calculated in each test procedure for the test swatches as follows, the values obtained for any given detergent formulation being the average of the individual values so determined:

$$\% \text{ Soil Removal} = \frac{R_w - R_s}{R_o - R_s} \times 100$$

where:

$R_w$=Average reflectance of washed soiled cloths $R_s$=Average reflectance of unwashed soiled cloths $R_o$=Average reflectance of unsoiled cloths before washing Thus the higher the value for % Soil Removal, the greater the detergency.

In the germicidal activity test, EPA protocols require a germ reduction of at least 99.90% for laundry sanitizers against the two test organisms, *K. pneumoniae* and *S. aureus.*

Eye irritation results are expressed in terms of Draize scores in accordance with the standard FIFRA method.

Skin irritation scores are expressed in terms of Primary Irritation Index (P.I.I.) also in accordance with the standard FIFRA method. The lower the score thus obtained, the less irritating is the formulation.

The results obtained are set forth in Tables 2, 3 and 4 where EMPA and Krefeld detergency results are expressed in terms of soil removal values; the antimicrobial activity is expressed in terms of percent germ reduction and antimicrobial effectiveness based on the above-noted EPA protocols; eye irritation is expressed in terms of Draize scores; and skin irritation is expressed as P.I.I. values.

TABLE 2

| | (EMPA/Krefeld Detergency) | |
|---|---|---|
| Formulation | EMPA | Krefeld |
| A | 35 | 43 |
| C | 36.4 | 40.6 |
| D | 36 | 40 |
| L | 27.0 | 9.2 |
| M | 22.8 | 7.9 |
| N | 26 | 10 |

TABLE 3

| | (Antimicrobial Activity vs. *K. pneumoniae* and *S. aureus*) | |
|---|---|---|
| Formulation | % Germ Reduction | Sanitization Result |
| A | 99.9 | Effective |
| B | 99.9 | Effective |
| C | 99.9 | Effective |
| L | 99.9 | Effective |
| M | 99.9 | Effective |
| N | 99.9 | Effective |
| O | 99.7 | Not Effective |

TABLE 4

| | (Irritancy Scores) | |
|---|---|---|
| Formulation | Eye Irritancy (Highest mean Draize Score) | Skin Irritancy (P.I.I.) |
| A | 16.3 (unwashed)<br>7.7 (washed) | 0.71 |
| N | 73 (unwashed)<br>58 (washed) | 2.78 |

These results show that formulations A, C and D prepared in accordance with the invention are markedly superior in detergency properties, as determined in both EMPA and Krefeld detergency tests, to any of comparative formulations L, M and N. Formulations A, B and C are also shown to be equally or more effective in antimicrobial activity to comparative formulations L, M, N and O, and Formulation A is shown to have lower eye and skin irritancy than comparative formulation N.

The liquid laundry detergent formulations of the invention are formulated as concentrates. In use the concentrate is added to the wash water in such amounts as to provide good cleaning and sanitization. It has been found that about ½ cup (about 4 ounces) of concentrate per wash load (or about 4 ounces per 16 gallons), which provides a use dilution of around 1:500, is adequate to achieve such purposes.

We claim:

1. A liquid laundry detergent and sanitizing composition comprising: (A) from about 5.5 to about 20 weight percent of a polymeric linear quaternary ammonium salt selected from the group consisting of a compound having the formula:

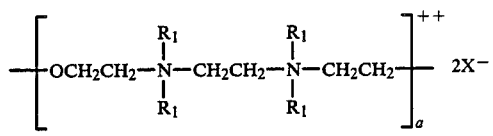

IA where $R_1$ is lower-alkyl having from one to four carbon atoms, a is an integer from 4 to 40 and $X^-$ is halide, and a compound having the formula:

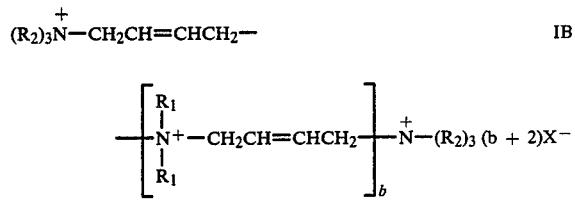

IB where $R_2$ is hydroxy-lower-alkyl having from two to four carbon atoms, b is an integer from 27 to 57 and $R_1$ and $X^-$ have the meanings given above; (B) from about 5 to about 50 weight percent of one or more nonionic surfactants selected from the group consisting of a compound having the formula:

$$R_4—(OCH_2CH_2)_cOH \qquad \text{IIA}$$

where $R_4$ is $C_{11}$–$C_{15}$ alkyl and c is an integer from 5 to 15, a compound having the formula:

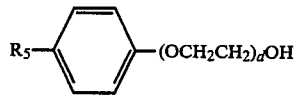

IIB where $R_5$ is $C_8$–$C_9$ alkyl and d is an integer from 7 to 13, a compound having the formula:

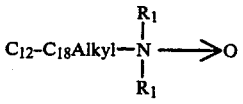

IIC where $R_1$ has the meaning given above, and an alkyl polyglycoside; and (C) water.

2. A composition according to claim 1 wherein the quaternary ammonium salt is a compound of formula IA.

3. A composition according to claim 1 wherein the quaternary ammonium salt is a compound of formula IB.

4. A composition according to claim 1 containing a nonionic surfactant of formula IIA.

5. A composition according to claim 1 containing a mixture of nonionic surfactants of formulas IIA and IIC.

6. A composition according to claim 4 containing from about 5.5 to about 10 weight percent of the quaternary ammonium salt and from about 5 to about 17 weight percent of the nonionic surfactant.

7. A composition according to claim 5 containing from about 5.5 to about 10 weight percent of the quaternary ammonium salt and from about 5 to about 17 weight percent of the mixture of nonionic surfactants.

8. A composition according to claim 4 containing from about 5.5 to about 10 weight percent of the quaternary ammonium salt and from about 5 to about 17 weight percent of the nonionic surfactant.

9. A composition according to claim 5 containing from about 5.5 to about 10 weight percent of the quaternary ammonium salt and from about 5 to about 17 weight percent of the mixture of nonionic surfactants.

10. A composition according to claim 6 containing about 6 weight percent of poly[oxyethylene(dimethyliminio)ethylene(dimethyliminio)ethylene dichloride] and about 12 weight percent of pareth-45-7.

11. A composition according to claim 8 containing about 6 weight percent of poly(dimethyl butenyl ammonium chloride)-α,ω-bis-triethanolammonium chloride and about 12 weight percent of pareth-45-7.

12. A composition according to claim 10 which includes up to about 7 weight percent of ethanol.

13. A composition acording to claim 11 which includes up to about 7 weight percent of ethanol.

* * * * *

UNITED STATES PATENT AND TRADEMARK OFFICE

CERTIFICATE OF CORRECTION

PATENT NO. : 4,755,327

DATED : July 5, 1988

INVENTOR(S) : Ernest Bernarducci and Kenneth A. Harrison

It is certified that error appears in the above-identified patent and that said Letters Patent is hereby corrected as shown below:

Column 4, line 2, change "alkylphenol" to read -- alkylphenyl -- and line 11, change "N-alkyl-N,N-di-lower-alkylamide-N-oxide" to read -- N-alkyl-N,N-di-lower-alkylamine-N-oxide --.

Signed and Sealed this

Ninth Day of April, 1991

*Attest:*

HARRY F. MANBECK, JR.

*Attesting Officer*

*Commissioner of Patents and Trademarks*